United States Patent [19]

Brooks

[11] Patent Number: 4,778,599

[45] **Date of Patent: * Oct. 18, 1988**

[54] CLEANING OF A BODY OF LIQUID BY SURFACE AGITATION

[75] Inventor: David A. Brooks, Roodepoort, South Africa

[73] Assignee: Spooner Est, Vaduz, Liechtenstein

[ * ] Notice: The portion of the term of this patent subsequent to Mar. 24, 2004 has been disclaimed.

[21] Appl. No.: 927,879

[22] Filed: Nov. 7, 1986

Related U.S. Application Data

[63] Continuation-in-part of Ser. No. 710,069, Mar. 11, 1985, Pat. No. 4,652,366.

[51] Int. Cl.[4] ..... E04H 3/16

[52] U.S. Cl. ..... 210/780; 210/169; 210/242.1; 15/1.7; 134/167 R; 366/241; 366/280; 366/343

[58] Field of Search ..... 210/169, 416.2, 242.1, 210/238, 144, 145, 702, 780; 15/1.7; 134/167 R; 366/241, 280, 343

[56] References Cited

U.S. PATENT DOCUMENTS

| | | | |
|---|---|---|---|
| 3,032,044 | 5/1962 | Pansini | 134/167 R |
| 3,108,298 | 10/1963 | Gelinas | 210/169 |
| 3,170,180 | 2/1965 | Winston et al. | 134/167 R |
| 3,261,371 | 7/1966 | Vernon | 134/167 R |
| 3,291,145 | 12/1966 | Arneson | 134/167 R |
| 3,295,540 | 1/1967 | Ortega | 15/1.7 |
| 3,758,276 | 4/1973 | Bond et al. | 210/169 |
| 3,860,518 | 1/1975 | Henricksen | 210/169 |
| 3,883,366 | 5/1975 | Blumenfeld | 134/167 R |
| 3,926,667 | 12/1915 | Gibellina | 134/167 R |
| 3,972,339 | 8/1976 | Henkin et al. | 15/1.7 |
| 4,040,864 | 8/1977 | Steeves | 134/167 R |
| 4,072,030 | 2/1978 | Garlinghouse | 366/219 |
| 4,087,286 | 5/1978 | Sexton | 134/167 R |
| 4,178,949 | 12/1979 | Mazon, III | 134/167 R |
| 4,281,995 | 8/1981 | Pansini | 134/167 R |
| 4,289,155 | 9/1981 | Sable | 134/167 R |
| 4,348,192 | 9/1982 | Pansini | 134/167 R |
| 4,356,582 | 11/1982 | Stephenson | 134/167 R |
| 4,429,429 | 2/1984 | Altschul | 134/167 R |
| 4,431,538 | 2/1984 | Selsted | 210/169 |
| 4,503,874 | 3/1985 | Norton | 210/169 |
| 4,624,274 | 11/1986 | Norton | 210/169 |
| 4,640,783 | 2/1987 | Kern | 210/169 |
| 4,652,366 | 3/1987 | Brooks | 210/169 |

FOREIGN PATENT DOCUMENTS

| | | | |
|---|---|---|---|
| 2255784 | 5/1973 | Fed. Rep. of Germany | 210/169 |
| 2209137 | 8/1973 | Fed. Rep. of Germany | 134/167 R |
| 2360029 | 6/1975 | Fed. Rep. of Germany | 210/169 |

*Primary Examiner*—Richard V. Fisher
*Assistant Examiner*—Coreen Y. Lee

[57] ABSTRACT

An automatic swimming pool cleaning apparatus has a surface supply hose connected to a floating unit and a further underwater hose that is connected at one end to the surface unit in fluid communication with the outlet of the surface hose and at its other outlet end to a non-buoyant cleaning unit. The underwater hose and the cleaning unit have jets directed in a downstream direction so that the cleaning unit moves through water in the pool and the underwater hose pushes the surface unit around. The cleaning unit carries a bag in which debris is collected. The surface hose also carries a jet to pull the surface unit around. The surface unit also has a jet which displaces and rotates the surface unit. The surface unit has a flotation member that is rotatable about a vertical axis. A first connector is rotatably mounted below the flotation member and a second connector is rotatably connected to the first connector. The first connector has a transverse inlet connected to the outlet of the surface hose and an axial outlet which communicates with an opposed axial inlet of the second connector. The second connector has a transverse outlet connected to the inlet of the underwater hose. A strap limits relative rotation of the first and second connectors. The flotation member also carries a rotatable spinner that is unbalanced to cause the flotation member to wobble.

21 Claims, 10 Drawing Sheets

CLEANING OF A BODY OF LIQUID BY SURFACE AGITATION

RELATED APPLICATION

This application is a continuation-in-part of my copending application Ser. No. 710,069 filed Mar. 11, 1985 and now U.S. Pat. No. 4,652,366.

BACKGROUND OF THE INVENTION

1. Field of the Invention

This invention relates in general to the cleaning of a body of a liquid and in particular to an apparatus for cleaning debris from a swimming pool.

2. Description of the Prior Art

Removal of debris such as leaves, pieces of paper, stones, blades of grass and the like from swimming pools, and the dislodging of dust and dead algae from the walls and floor of a swimming pool are continual problems. Many devices are known for cleaning swimming pools, many of them being automatic in operation. Some of these automatic apparatus operate on a suction principle and others on a pressure principle. A number of these apparatus that operate on a pressure principle have been patented and the following U.S. patents are representative: U.S. Pat. Nos. 4,281,995—Pansini, 4,040,864—Steeves, 3,032,044—Pansini, 4,087,286—Sexton, 4,503,874—Norton, 4,289,155—Sabie, 3,295,540—Ortega, 3,261,371—Vernon and 4,429,429—Altschul.

The patents listed above disclose automatic cleaning apparatus that work on the pressure principle. Some of these apparatus such as that described in Altschul and Steeves show a bag for collecting debris. The bags are secured to the ends of hoses, and the bags are propelled through the water by means of water jets located at the ends of the hoses. The other apparatus have flagellating hoses that whip about in the pool to disturb dirt and hold it in suspension to be removed by a filtration system of the pool. Several of these patents show these flagellating hoses supported by floating units. The floating units are propelled about the surface of the pool thereby moving the flagellating hoses about in the pool.

A prime requirement for all swimming pool cleaning apparatus is that the apparatus must move as randomly as possible through the pool and must not get stuck in corners, on steps, or be caught by items such as drains that project into the pool.

SUMMARY OF THE INVENTION

It is a general object to provide an improved apparatus for automatically cleaning a body of liquid, in particular a swimming pool. It is a further object to provide an apparatus that moves randomly in the body of liquid and which does not get stuck by obstacles such as corners, stairs and the like in the body of liquid.

The present invention accordingly provides an apparatus for cleaning a body of liquid, in particular a swimming pool, that has a supply hose, a buoyant unit, a drive hose, and a debris collecting device.

The supply hose has an inlet end connectable to a source of liquid under pressure and an outlet end that is connectable to the surface unit. Intermediate its ends the supply hose has a drive jet that is angled towards the outlet end to provide a thrust that has a longitudinal component that causes the outlet end to be pulled through the water and a transverse component that moves the hose at the position of the jet sideways in the water thereby causing the direction in which the outlet end is moved to be varied.

The surface unit has a buoyant support element that has an underneath side and a top side. A first and a second connecting element are rotatably mounted on the underneath side of the support element. The support element is rotatable with respect to the first connecting element and the first and second connecting elements are similarly relatively rotatable. All three components are rotatable about the same axis which is vertically oriented. The first connecting element has a transverse inlet that is connected to the outlet end of the supply hose and an axial outlet that is connected to an axial inlet of the second element. The second element further has a transversely directed outlet. Although the first and second connecting elements are relatively rotatable, a strap is provided to limit relative rotation thereof. On its underneath side the support element carries a jet that is spaced from the longitudinal axis and which is in fluid communication with the interior of the first connecting element. Water exiting from this jet exerts a thrust on the support element, the thrust having a component that passes through the rotational axis to displace the support element through the water and a tangentially directed component which causes the element to rotate. On its top side, the support element has a member that is also rotatably mounted about the rotational axis. This member carries jets that are in fluid communication with the interior of the first connecting element and spray liquid onto the surface of the body of liquid and also cause the member to rotate. As the member carries an unbalancing mass, it wobbles as it rotates, causing the support element to disturb the surface of the liquid and also assisting relative rotation of the various parts by impeding their sticking.

The drive hose has its inlet end connected to the outlet of the second connecting element and has a remote outlet end. Intermediate its ends the drive hose has a number of jets that are angled towards the outlet end in a similar manner to the jet of the supply hose. As a result, a pushing force is exerted on the second connecting element and a pulling force is exerted on the outlet end of the drive hose. Along its length the drive hose also has several swivel connectors, so that various sections of the drive hose can swivel relative to one another. As a result of this swivelling feature the transverse forces exerted on the various sections by water exiting from the various jets, change in relative direction thereby constantly varying the forces exerted on the drive hose along its length.

A debris collecting device is connected to the outlet end of the drive hose. The debris collecting device has a bag with a mouth that faces towards the outlet end of the drive hose. The debris collecting device also has a main jet that is in fluid communication with the drive hose and which is angled away from the outlet end to exert a longitudinal force on the device to move it towards the outlet end of the drive hose and a transverse force to displace it to one side. An auxiliary jet, also in communication with the drive hose, is carried by the device and is directed generally towards the mouth to assist in the capture of debris.

It will be appreciated that the surface unit is displaced by a number of forces. Thus, there is the pulling force exerted on the first connecting element, the pushing force exerted on the second connecting element and the forces exerted on the support element. As the support element, the first connecting element and the second connecting element are all relatively rotatable, the direction and speed of movement of the surface unit will vary constantly thereby increasing the randomness of its movement and assisting it in getting out of corners or away from other obstacles. The likelihood of the surface unit or of the debris collecting device getting stuck is also minimised by the fact that the support element rotates and if it is in contact with a wall or with a portion of the supply hose, it will tend to move therealong. Further, as relative rotation of the first and second connecting elements is limited, if they are at the limit of relative rotation in one direction and the surface unit gets stuck, due to the varying forces exerted on the surface and drive hoses, the first and second connecting elements will after a short period of time tend to rotate in an opposite direction to exert a force on the surface unit that will move it away from its stuck position.

BRIEF DESCRIPTION OF THE DRAWINGS

The invention is now described, by way of examples, with reference to the accompanying drawings, in which.

DESCRIPTION OF TWO PREFERRED EMBODIMENTS

Figure 1:
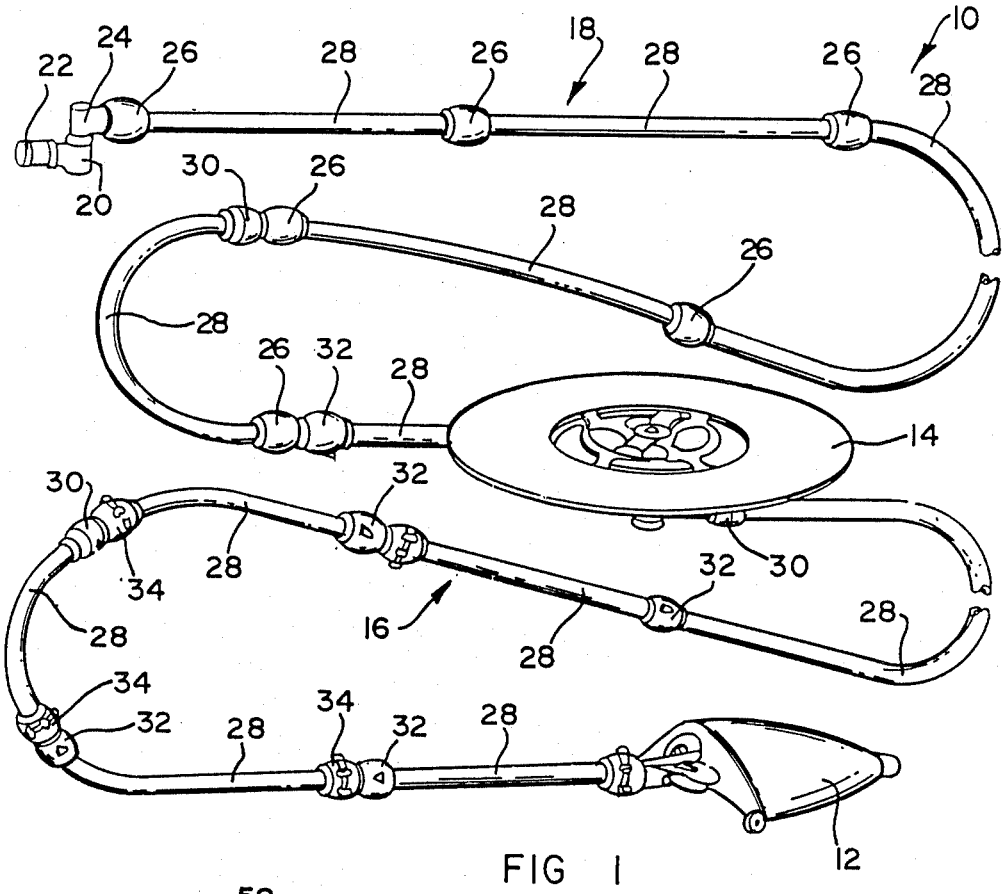
FIG. 1 shows a perspective view of a first embodiment of a swimming pool cleaning apparatus in accordance with the invention.

Referring to FIG. 1 of the drawings, an embodiment of a swimming pool cleaning apparatus is designated generally by reference numeral 10. As will be explained below, the apparatus 10 operates by means of a pressure principle.

The apparatus 10 has two prime components—a cleaning head 12 and a surface unit 14. The cleaning head 12 is shown in more detail in FIGS. 2 and 3 and the surface unit 14 is shown in more detail in FIGS. 4, 5 and 6. The cleaning head 12 is connected to the surface unit 14 by means of an underwater hose 16 and the surface unit 14 is connected to an inlet of the swimming pool that is to be cleaned (not shown) through which water returns to the pool, by means of a surface hose 18 and a swivel connector 20.

The connector 20 has a tubular inlet 22 which is engaged with the inlet of the swimming pool and an outlet 24 which is connected to the hose 18 by means of a connector 26. The inlet 22 and outlet 24 are swivably connected to one another. The hose 18 comprises sections 28 which are connected to one another by means of connectors 26, 30 and 32. The connectors 26 have buoyant elements which cause the hose 18 to float on the surface. The connectors 30 are swivel connectors and are shown more clearly in FIG. 9. The connectors 32 have jets and are shown more clearly in FIG. 7.

Similarly, the underwater hose 16 has sections 28 that are the same as those for the surface hose 18, the sections 28 being connected to one another by jet connectors 32, the swivel connectors 30 and wheeled connectors 34. The wheeled connectors 34 are shown in more detail in FIG. 8.

Figure 2:
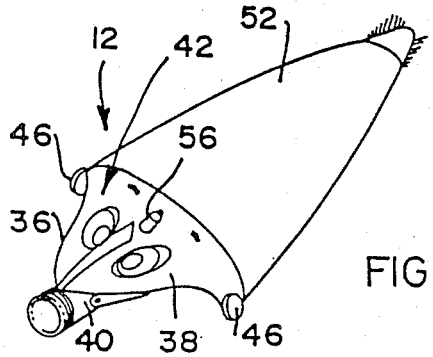
FIG. 2 shows a plan view of a cleaning head of the apparatus.
Figure 3:
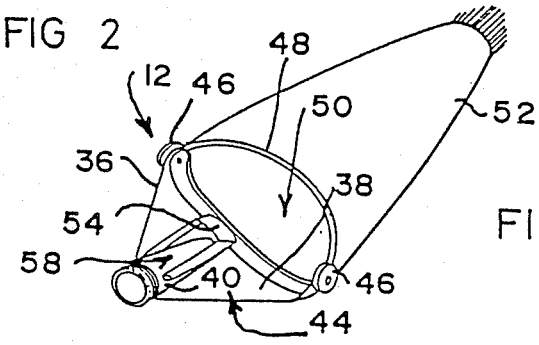
FIG. 3 shows an underneath plan view of the cleaning head.

Turning now to FIGS. 2 and 3, the cleaning head 12 is shown. The cleaning head 12 has a body portion 36 that comprises a curved section 38 and a hollow central section 40. The curved section 38 is curved to define a convex side 42 and a concave side 44. At the ends of the curved section 38 wheels 46 are provided. A curved support member 48 is also connected to the ends of the curved section 38 to define a mouth 50. The support member 48 also performs a scraping function. A woven bag 52 is secured to the support member 48 and the curved section 38 such that, as the body portion 36 is displaced through the water (in a manner which will be described below) water with debris suspended therein flows into the bag 52 through the mouth 40, with debris being collected in the bag 52. A scraper member 54 which is angled with respect to the body portion 36 and which is hingedly attached thereto, on the convex side 44 of the body portion 36, is also provided. The scraper 54 is angled such that it is displaced away from the body portion 36 as the body portion 36 is displaced through the water. The body portion 36 is displaced through the water by means of a main jet 56 which projects from the convex side 42 of the body portion 36 and is angled thereto, pointing in the general direction of the bag 52 and keeping the wheels 46 in contact with the walls or floor of the pool. The jet 56 communicates with the interior of the hollow section 40. A smaller auxiliary jet 58 is provided on the other side of the body portion 36 and is angled towards the mouth 50 to assist the passage of debris into the bag 52. It will be appreciated, that in use, water flowing out of the main jet 56 causes the cleaning head 12 to be displaced through the water and to have a component of thrust towards the wheels 46.

Figure 4:
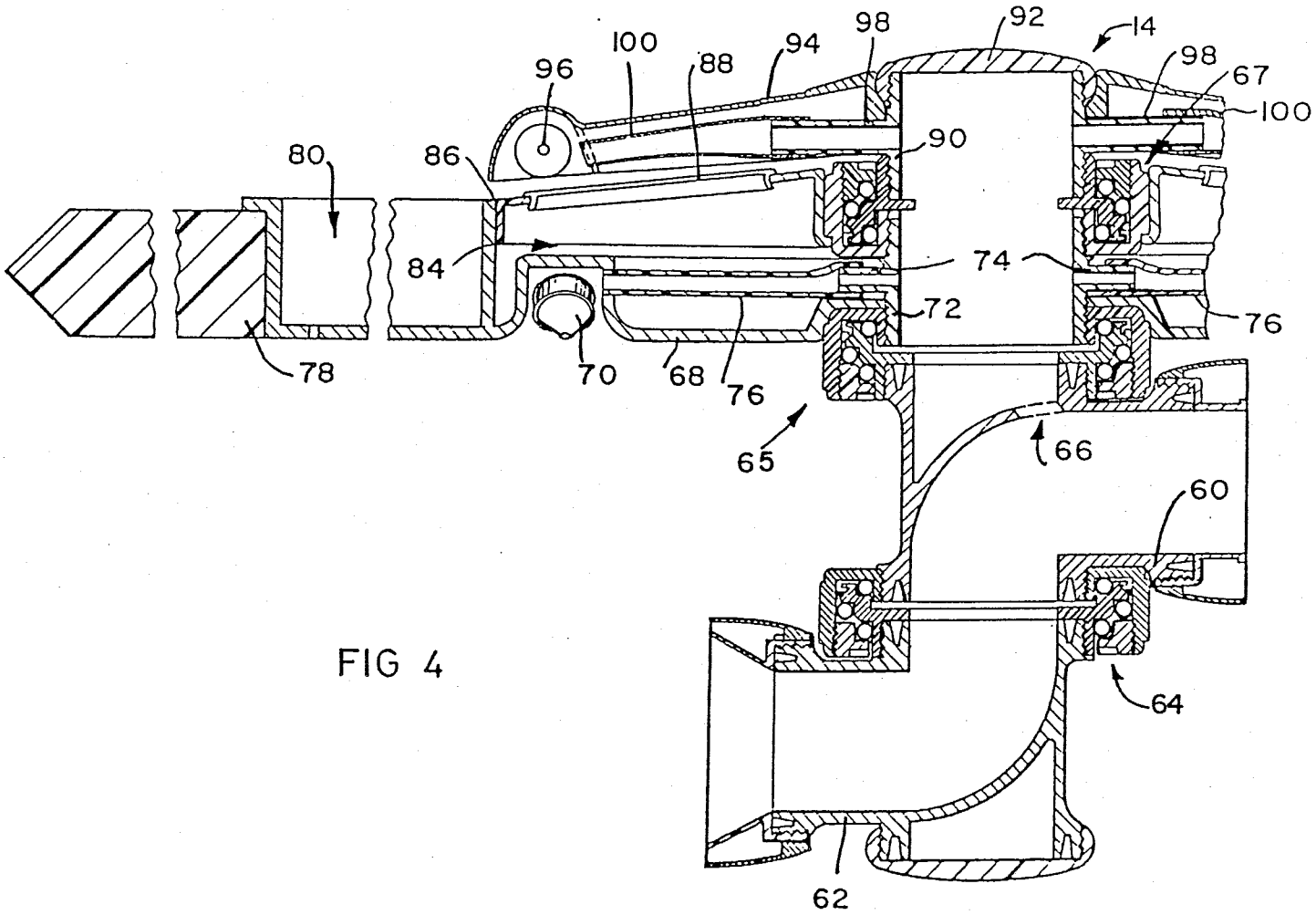
FIG. 4 shows a sectioned view of part of a surface unit of the apparatus.
Figure 5:
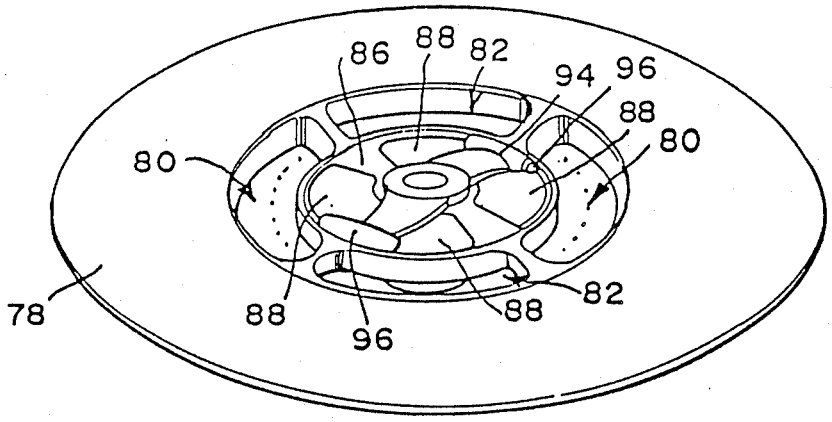
FIG. 5 shows an oblique plan view of the surface unit.
Figure 6:
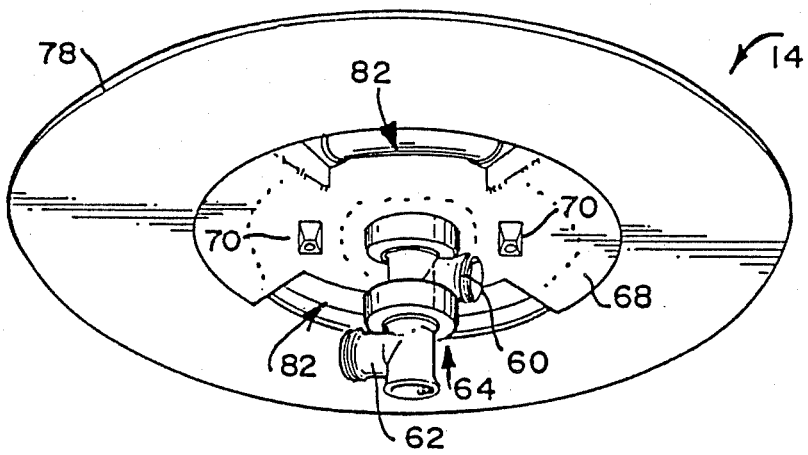
FIG. 6 shows an oblique underneath view of the surface unit.

Turning now to FIGS. 4, 5 and 6, the surface unit 14 is shown therein. The surface unit 14 has a tubular inlet member or first hollow connecting element 60 that is cranked and a tubular outlet member or second hollow connecting element 62 that is also cranked. The surface hose 18 is connected to the inlet member 60 and the underwater hose 16 is connected to the outlet member 62. The two members 60 and 62 are connected together by means of a bearing arrangement 64 so that they are rotatable with respect to a rotational axis which is vertically disposed in use. The inlet member 60 further has an aperture 66 through which water is supplied to further jets incorporated in the surface unit 14. Thus, the surface unit has a main tray 68 which is rotatably attached to the inlet member 60 by means of a further bearing arrangement 65 and carries two displacing jets 70 (only one of which is shown in FIG. 4) which project from the underneath surface of the tray 68 at an angle, as is shown in FIG. 6. The tray 68 is secured to a first tubular carrier 72 which in turn is connected to the inlet member 60 by means of the bearing arrangement 65, to be in communication with the aperture 66. This carrier 72 has two spigots 74 which are connected to the jets 70 by means of pipes 76. Although the jets 70 are equally spaced from a central axis of the tray 68, and are angled in the same direction, one of the jets is smaller than the other. Thus, in use, as water exits from the jets 70 the tray 68 will be displaced linearly through the water by a thrust vector component that passes through the rotational axis, and will also be rotated about the inlet member 60, which in turn will cause the abovementioned thrust vector component to change its alignment relative to the pool-shell.

Secured to the periphery of the central tray 68 is a ring 78 that is hollow or is of foamed plastic which causes the surface unit 14 to float in the water. Further, the central tray 68 has two outer compartments 80 for the dispersal of liquid or powdered chemicals, two openings 82 and an annular dished region 84 for the containment of chemical tablets. A cover 86 closes off this dished region 84. The cover 86 has four openings (for the insertion of tablets) which are closed by removable lids 88.

A second tubular carrier 90 is secured to the first carrier tube 72 by means of a further bearing arrangement 67 such that the carriers 90 and 72 are in communication with one another. The second carrier 90 is closed off by means of a cap 92. An off-balance spinner 94 is secured to the second carrier 90. The spinner 94 has two opposed jets 96 which are connected to spigots 98 of the second carrier 90 by means of pipes 100. In use, the spinner 94 is caused to rotate due to water exiting the jets 96. Because the spinner 94 is not balanced, this imparts a vibration to the surface unit 14 which inhibits sticking of the bearing arrangements 64, thus facilitating the constant and random re-alignment of the asymmetrical jets 70 of the surface unit 14 relative to the surface hose 18, and of the surface hose 18 relative to the underwater hose 16. Additionally, this vibration causes a pulsation down the length of both hoses 16 and 18, inhibiting their coming to rest against the pool-shell.

Figure 7:
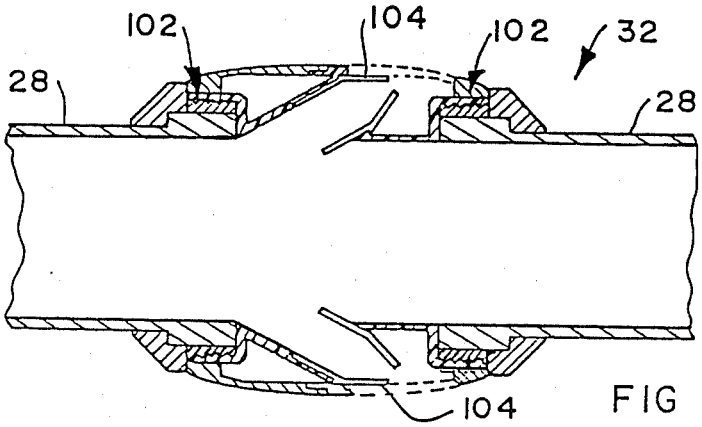
FIG. 7 shows a sectioned view of a jet connector which connects together two sections of hose of the apparatus.

Referring now to FIG. 7, a jet connector 32 is shown therein. The connector 32 has thread formations 102 at each end by means of which the hose sections 28 are secured thereto, and also incorporates cavities to hold weights for the attainment of optimum buoyancy of underwater hose 16. The connector 32 also has either one or two angled jets 104 which communicate with the interior thereof. It will be understood that in use water flows out of the jets 104 causing the connector 32 to be displaced in the water, thereby also moving the hose sections 28. Where two jets 104 are employed the resultant line of thrust is along the longitudinal axis of the hose 16, but where only one jet 104 is employed there is an additional component of thrust at right angles to this axis. The two or three jet connections 32 closest to the cleaning head 12 will have only one jet 104 each. The section of underwater hose 16 on which they occur will remain unswivelably fixed relative to the cleaning head 12, but swivelably fixed relative to the rest of the underwater hose 16. The line of thrust of each will be in the same plane as that of the main jet 56, and in view of the transverse component of thrust possessed by all these jets, the cleaning head 12 will be mostly held in contact with the walls and floor of the pool, and when it does break away will soon automatically correct its attitude and restore its wheel-to-wall/floor contact.

Figure 8:
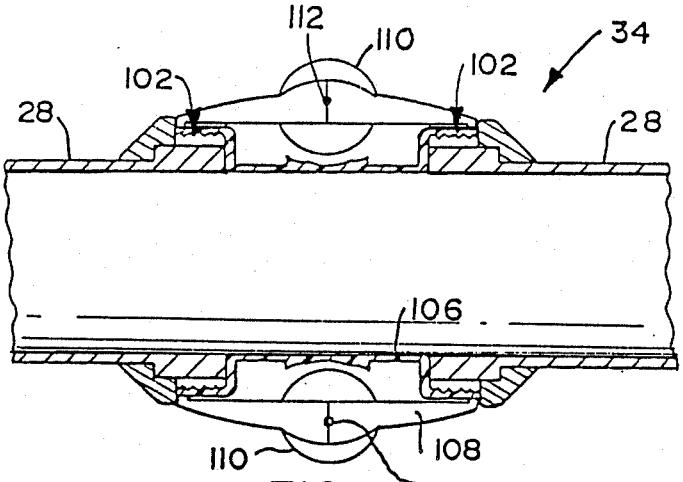
FIG. 8 shows a sectioned view of a wheeled connector.

Referring to FIG. 8, the wheeled connector 34 is shown therein. The connector 34 has a tubular body 106 which has threaded formations 102 for connection to the hose sections 28, as with the connector 32. A cage 108 is rotatably mounted on the body portion 106 to be rotatable about a longitudinal axis of the body portion 106. The cage 108 carries eight wheels 110 which are rotatable about axles 112 that are transverse to the longitudinal axis. Thus, as the hose sections 28 are displaced through the water, every now and again the hose sections 28 will tend to rub against wall or floor portions of the swimming pool. At these times, the wheels of the connectors 34 will engage the walls or floor thereby protecting the hose sections 28 and facilitating movement of the underwater hose through the water both in the direction of its longitudinal axis and at right angles to it.

Figure 9:
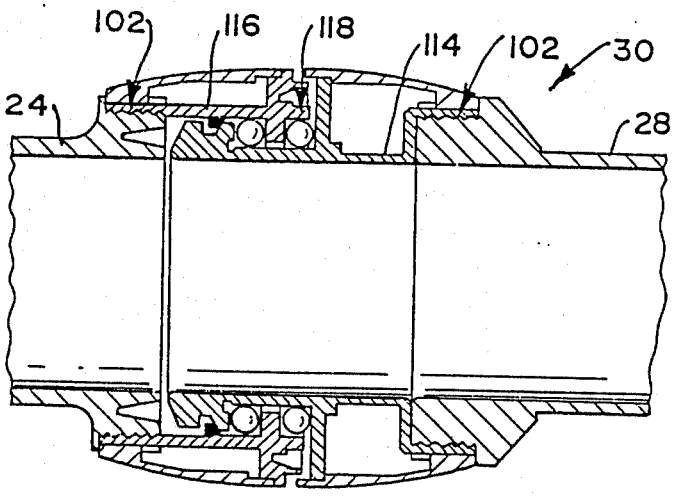
FIG. 9 shows a sectioned view of a swivel connector.

Referring to FIG. 9, a swivel connector 30 is shown. The swivel connector 30 has tubular portions 114 and 116 which each have threaded regions 102 and are swivably connected to one another by means of a bearing arrangement 118. By means of the bearing arrangement 118 the members 114 and 116 are able to rotate with respect to one another. Thus, adjacent hose sections 28 may rotate with respect to one another, thus randomly altering the resultant directions of thrust of those jet connectors 32 having only one angled jet 104.

Figure 10:
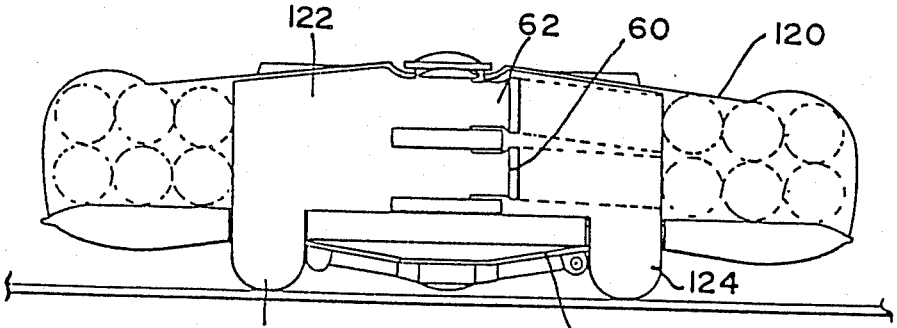
FIG. 10 shows schematically how the surface unit is utilised to store hoses of the apparatus.

Referring to FIG. 10, the surface unit 14 is shown in an inverted position with a reel unit 120 that is utilised to roll up the surface hose 18 and underwater hose 16 about a core 122 that has feet 124 which project through the apertures 82 in the central tray 68.

It will accordingly be understood that when the apparatus 10 is in use, the cleaning head 12 is caused to move through the water collecting dirt therein. Due to the action of the main jet 56 and the jets 104 of the connectors 32 the underwater hose 28 and the cleaning head 12 move randomly through the swimming pool. Further, due to the inter-dependent action of the jet connectors 32, the swivel connectors 30 and the wheel connectors 34 the possibility of the cleaning head 12 being caught in any part of the pool is extremely small. Further, due to the constant and random realignment of these components the possibility of the cleaning head 12 moving through a repeating pattern is also very small. Further, as the surface unit 14 itself moves randomly around the pool the randomness of movement of the cleaning head 12 is enhanced. It will also be appreciated that if the surface unit 14 comes into contact with a wall portion of the swimming pool, it will rotate as it moves along the wall, thus overpowering the lesser tendency to rotate caused by the asymmetrical jets 70 (in conjunction with the vibration caused by the spinner 94). The more sudden and vigorous realignment of the linear thrust vector of the jets 70 further enhances the randomness of the entire system. When this line of linear thrust is opposed to the direction of movement of the underwater hose 16, the latter slows down and "snakes" randomly in both the horizontal and vertical planes.

When the linear thrust of these jets 70 is in the same direction as the movement of the underwater hose 16, the latter speeds up and proceeds from one area of the pool to another by a more direct route, tending to follow the equally rapid passage of the surface unit 14.

Figure 11:
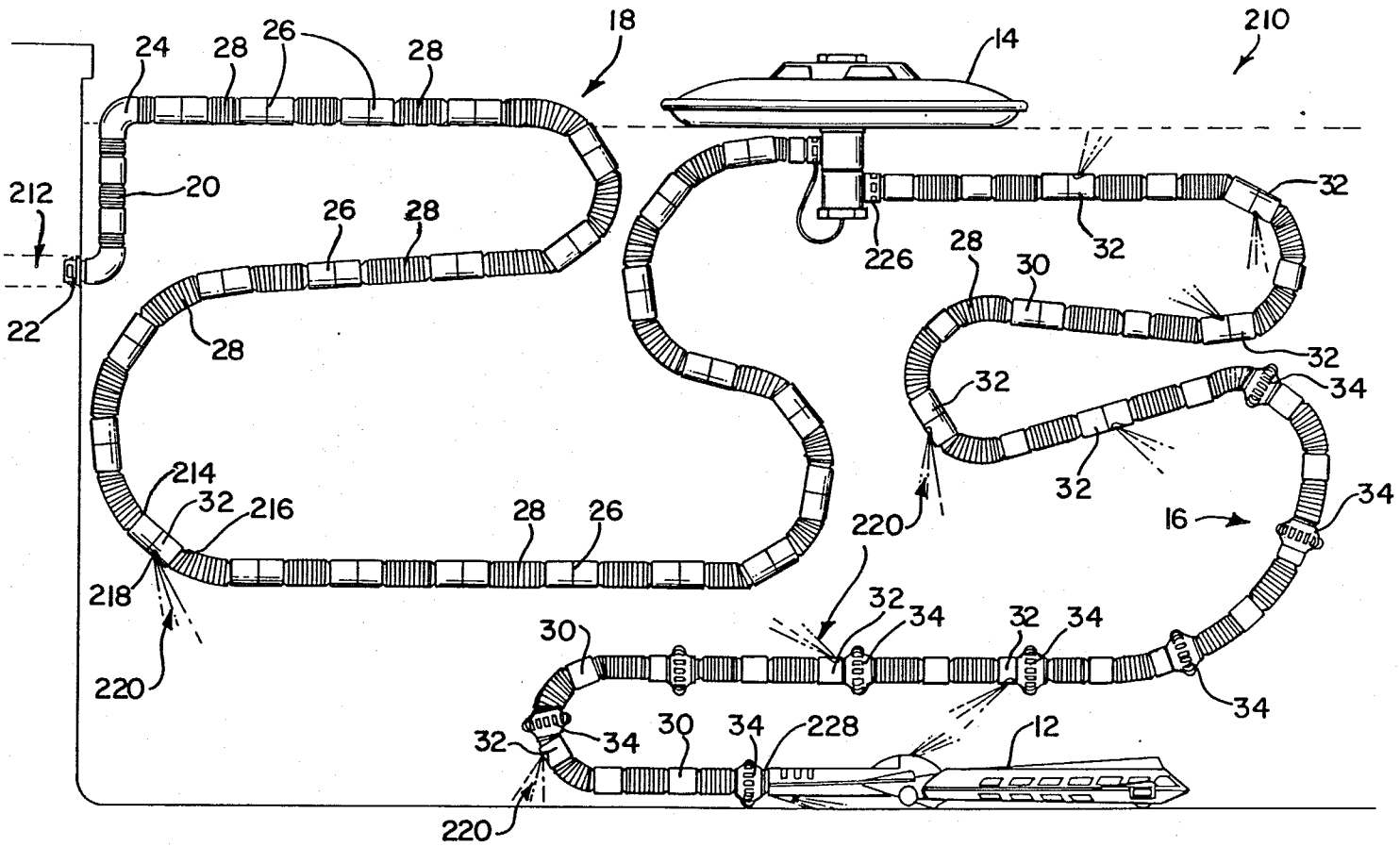
FIG. 11 shows a perspective view of a second embodiment of a swimming pool cleaning apparatus in accordance with the invention.
Figure 12:
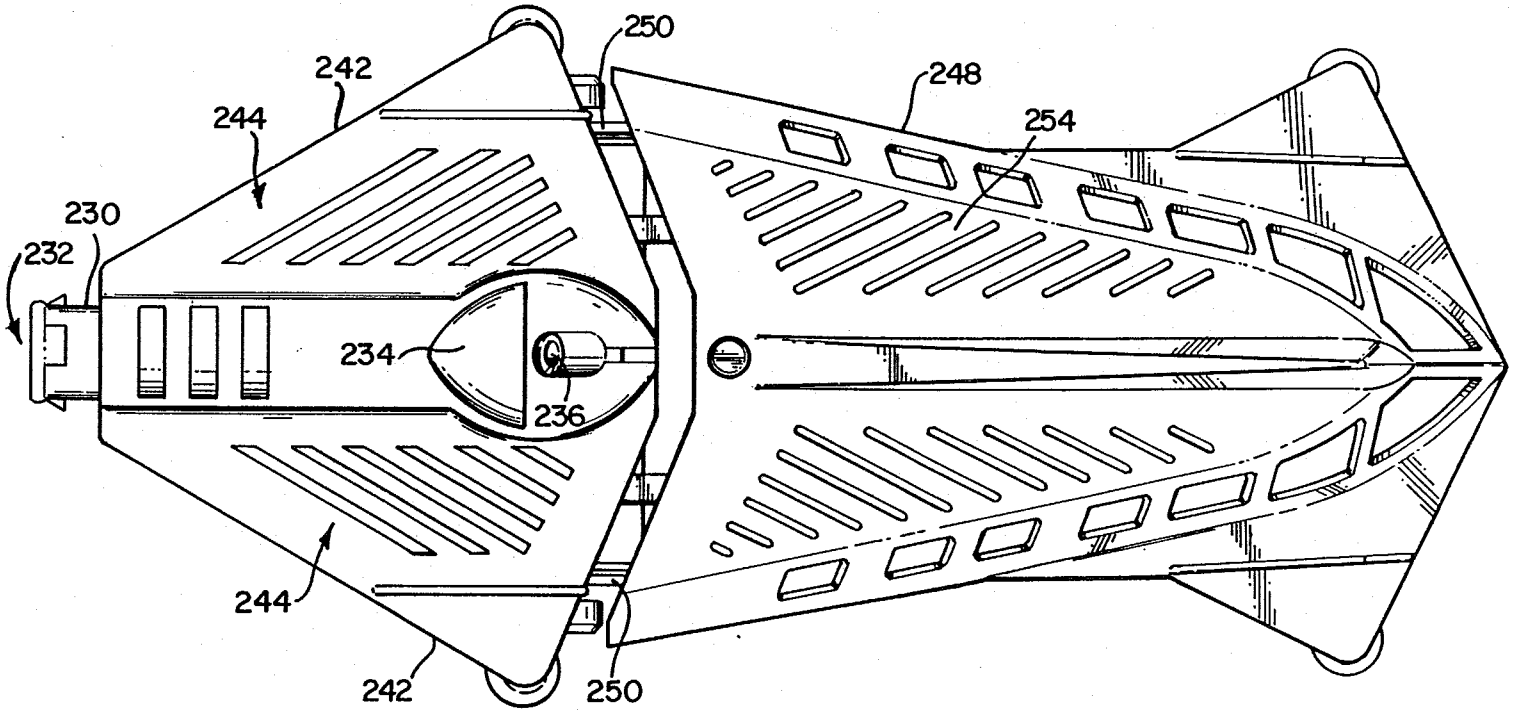
FIG. 12 shows a plan view of the cleaning head of the apparatus of FIG. 11.
Figure 13:
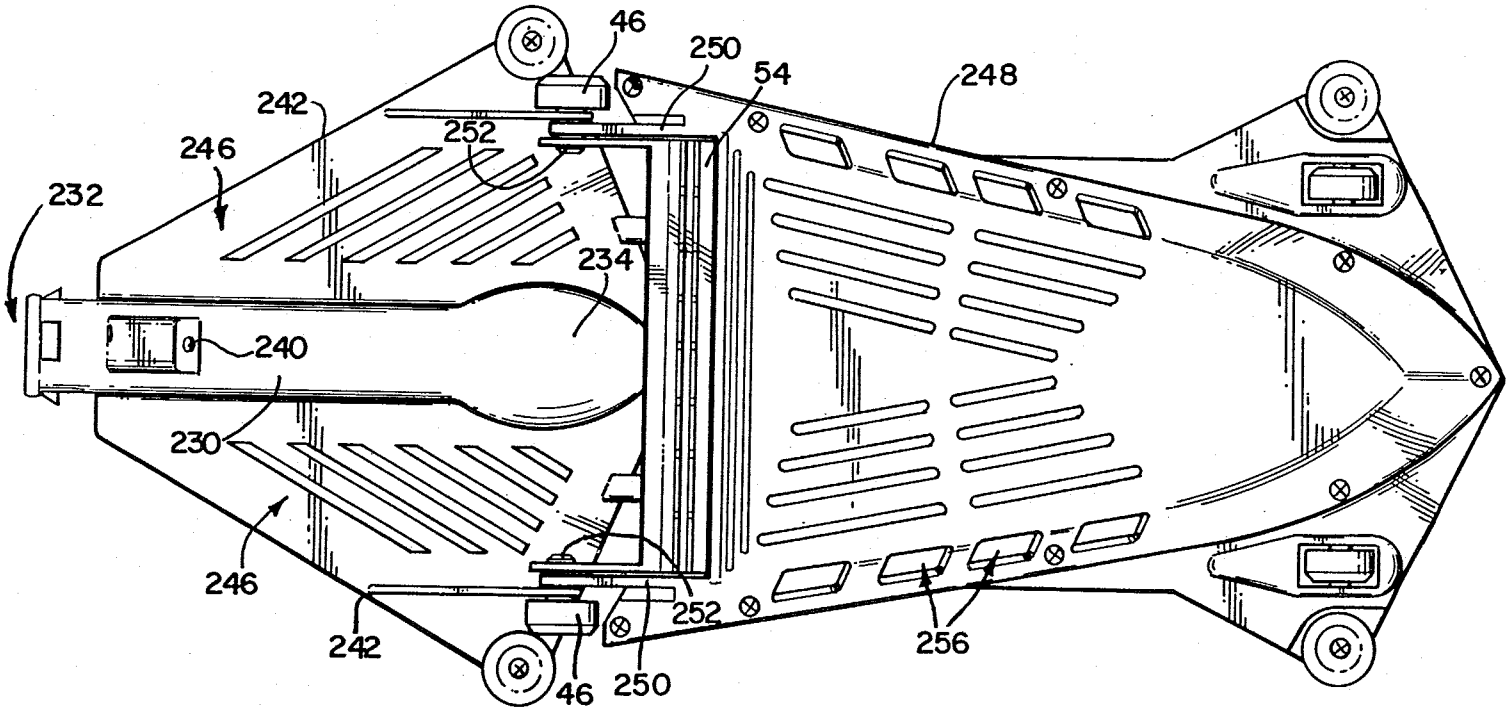
FIG. 13 shows an underneath plan view of the cleaning head.
Figure 14:
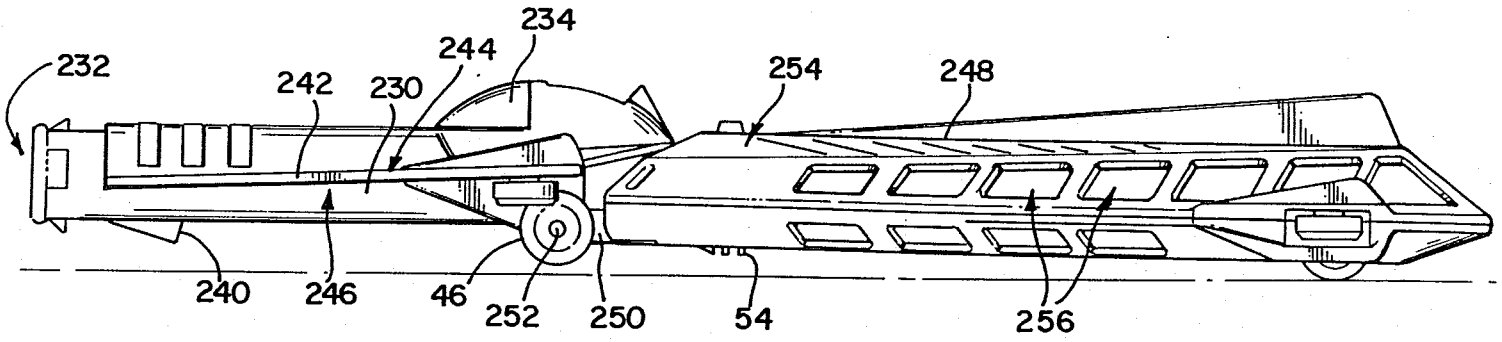
FIG. 14 shows a side view of the cleaning head.
Figure 15:
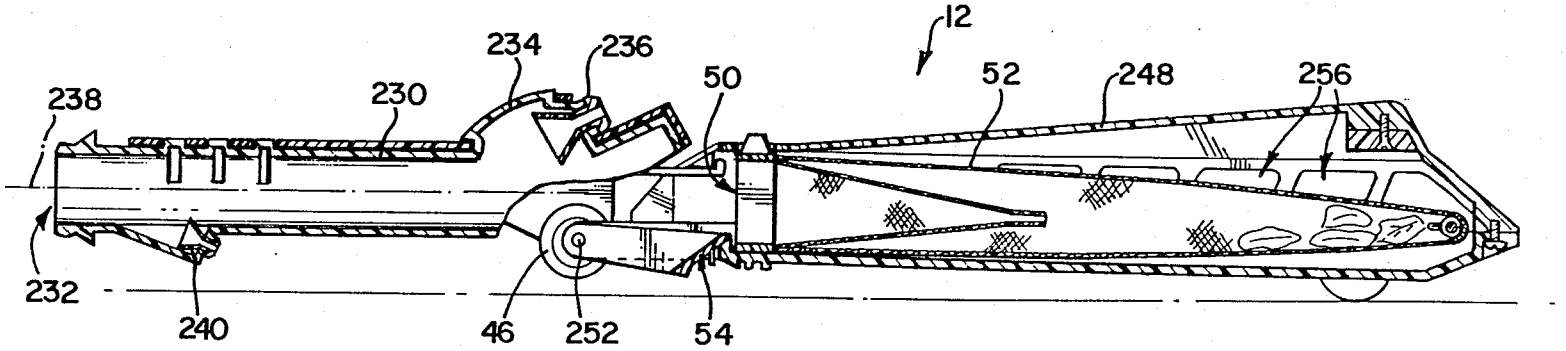
FIG. 15 shows a sectioned view of the cleaning head.

Referring now to FIG. 11, a second embodiment of an apparatus for cleaning a swimming pool is designated generally by reference numeral 210. The apparatus 210 is similar to the apparatus 10 of FIG. 1 and is similarly referenced. Thus the apparatus 210 has a cleaning head 12, a surface unit 14, an underwater hose 16 connecting the cleaning head 12 to the surface unit 14 and a surface hose 18 connecting the surface unit 14 to an inlet 212 through which filtered water is returned to the pool, under pressure, from a pump (not shown).

Figure 18:
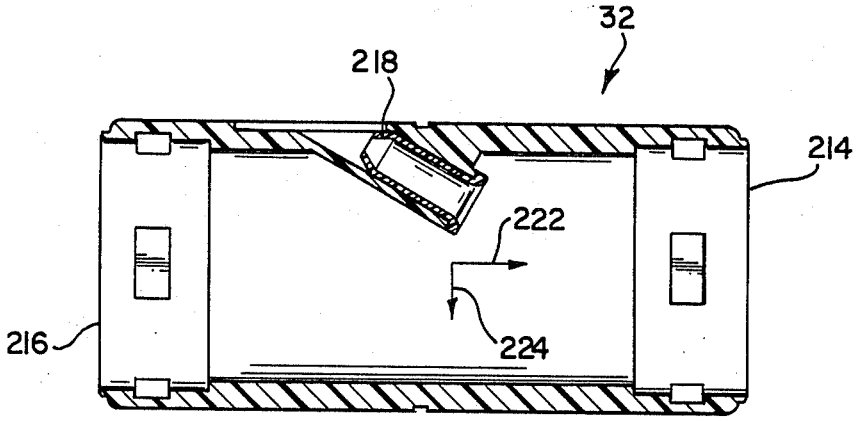
FIG. 18 shows a sectioned view of a jet connector.

The surface hose 18 of this apparatus 210 has only one jet connector 32 which is shown in more detail in FIG. 18. The connector 32 has an inlet end 214 and an outlet end 216. The connector 32 has a single jet 218 that is angled towards the outlet end 216 so that a jet of water is directed in a downstream direction as shown at 220 in FIG. 1. This jet of water 220 provides a thrust on the connector having a longitudinal component 222 directed in an upstream direction and a transverse component 224. The longitudinal thrust component 222 tends to move the connector 32, and the hose sections 28 connected thereto in an upstream direction and the transverse thrust component 224 tends to move the connector 32 sideways. Depending on the orientation of the portion of the surface hose 18 between the connector 32 and the surface unit 14, ie. if this portion is fairly straight, the surface hose 18 will exert a pulling force on the surface unit 14. If this portion is not straight, the thrust exerted on the connector 32 will tend to straighten this portion of the surface hose 18.

Similarly, the underwater hose 16 has jet connectors 32 that also all have only one jet 218, each jet 218 also being directed at an angle in the downstream direction. These jets 218 provide water jets 220 that each provide a thrust having a longitudinal component directed upstream so that the underwater hose 16 exerts a pushing force on the surface unit 14 and a pulling force on the cleaning head 12. The various jet connectors 32 of the underwater hose 16 also experience sideways forces that cause the various portions of the underwater hose 16 to move sideways. As there are the swivel connectors 30, the angular directions of the various transverse thrust components 224 of the jet connectors 32 about a longitudinal axis of each jet connector 32 varies resulting in extremely random movement of the hose sections 28, an inlet end 226 of the underwater hose 16 that is connected to the surface unit 14 and an outlet end 228 connected to the cleaning head 12.

Turning now to FIGS. 12 to 15 the cleaning head 12 has a hollow elongate body portion 230 having an inlet end 232 that is connected to the outlet end 228 of the underwater hose 16. At its other end, the body portion 230 has a bulbous region 234 in which is positioned a main jet 236 that is directed in a generally downstream direction, (ie. away from the inlet end 232) at an angle to a longitudinal axis 238 of the body portion 230. The body portion 230 also carries an auxiliary jet 240 intermediate its ends and on the other side of the body portion 230 to the main jet 236. The auxiliary jet 240 is also angled in a downstream direction so that water streams issuing from both the main jet 236 and the auxiliary jet 240 provide a thrust having a longitudinal component which moves the body portion 230 towards its inlet end 232, assisting the underwater hose 16 in moving the cleaning head through the water. The water streams exert transverse thrust components that exert a couple on the body portion 230 tending to rotate it against the drag of the underwater hose 16 so that the bulbous region 234 tends to be at an angle to the general direction of movement of the body portion 230.

Attached to the body portion 230 are two generally triangular and planar wings 242 which are substantially co-planar and define a median plane between the main jet 236 and the auxiliary jet 240. The wings 242 are nonetheless slightly angled, being closer to the main jet 236 at the bulbous region 234. The wings 242 extend almost from the inlet end 232 of the body portion 230 to the bulbous region 234 and widen out from the inlet end 232. The surfaces 244 of the wings 242 on the side of the main jet 236 constitute an upper side and the other surfaces 246, on the side of the auxiliary jet 240 constitute an underneath side of the cleaning head 12.

A flattened housing 248 extends back from the wings 242 and is pivotally attached thereto at the ends of arms 250 by pivot pins 252. The pins 252 also support wheels 46. In a normal position the upper side 254 of the housing 248 is substantially in line with the upper surfaces 244 of the wings 242. Further, at its front end adjacent the body portion 230, the housing 248 defines the mouth 50. The bag 52 is located within the housing 248 with its open end in the mouth 50. The housing 248 has openings 256 through which water that has passed into the mouth 50 and through the bag 52, may flow. It will be appreciated that the auxiliary jet 240 directs water flow generally in the direction of the mouth 50 and that if the underneath side of the cleaning head 12 is close to or against a floor or wall 258 of the pool, then water from the auxiliary jet 240 will dislodge dirt and will be deflected into the mouth 50. Further, the action of the main jet 236 and the angled wings 242 will tend to keep the cleaning head against the floor or wall 258.

Figure 16:
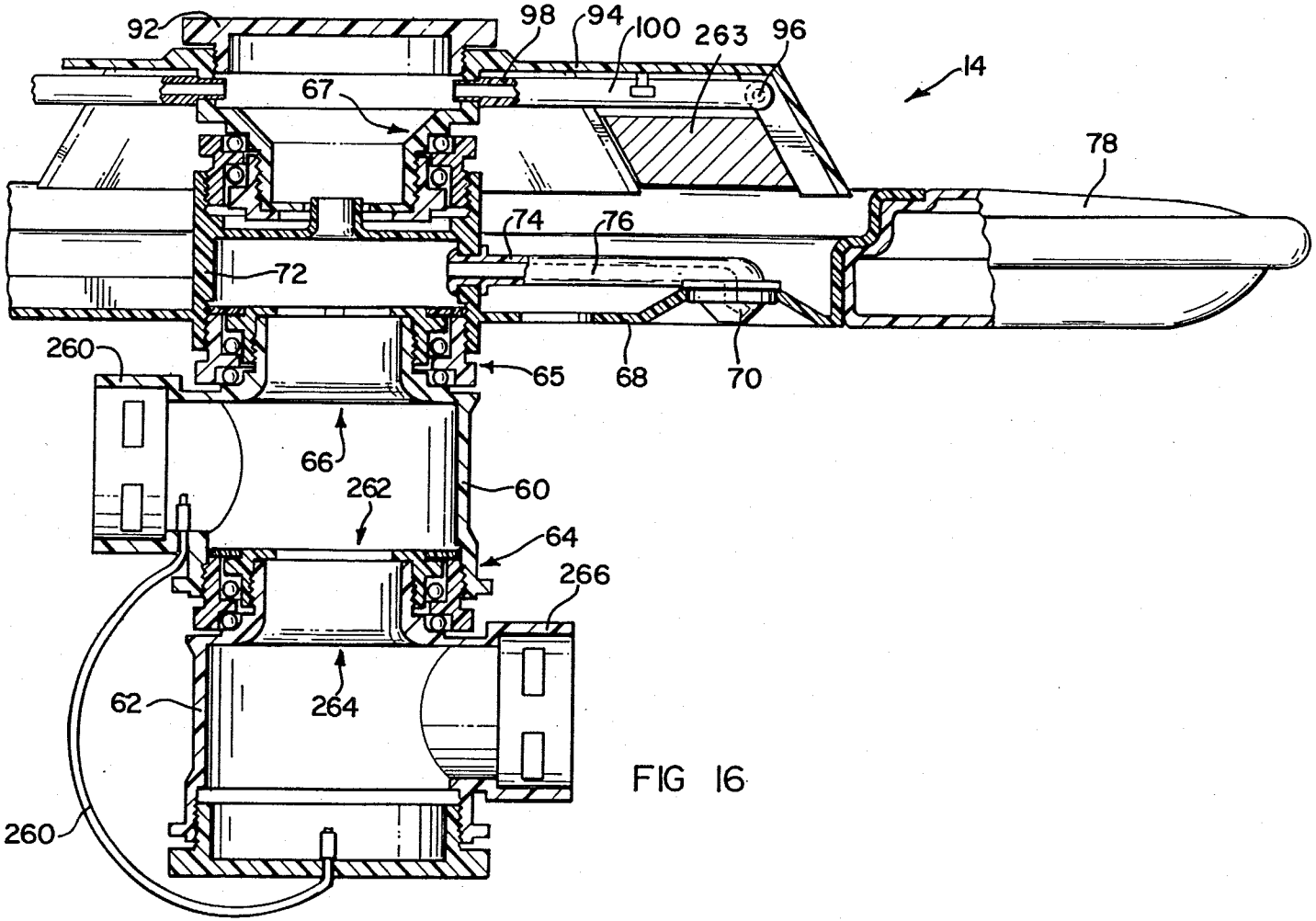
FIG. 16 shows a sectioned view of part of a surface unit of the apparatus of FIG. 11.
Figure 17:
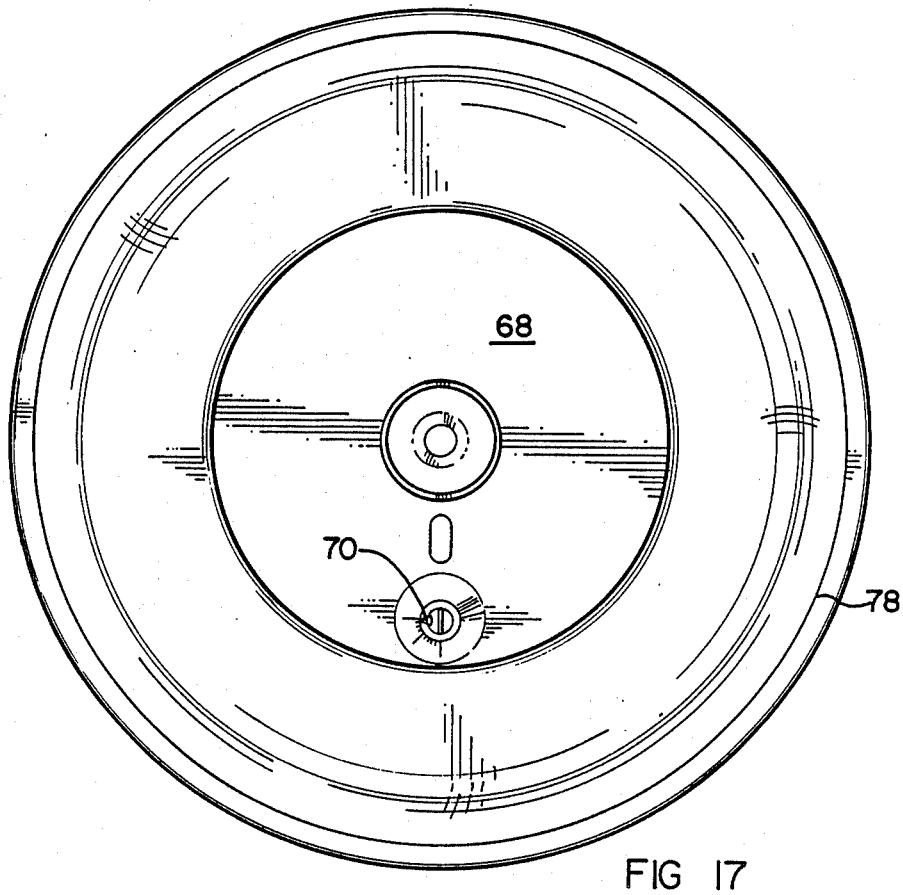
FIG. 17 shows an underneath plan view of the surface unit without its connecting elements.

With reference to FIGS. 16 and 17, it will be seen that the surface unit 14 of the apparatus 210 is substantially similar to the surface unit 14 of the apparatus 10, except for minor constructional detail and that this surface unit only has one displacing jet 70 which can be rotated through 90° to be directed tangentially to the vertical rotational axis or radially outwardly thereto or at any angle in between, and that there is a leash or strap 260 between the inlet member 60 and the outlet member 62 which limits relative rotation to about 630°. It will be noted further that there is an unbalancing mass 263 on the spinner 94 which causes it to wobble as it spins. In use the spinner 94 is above the surface of the water and water exiting from the jets 96 sprays onto the surface. It will be noted further that the member 60 and 62 are below the tray 68 and the member 60 has a transversely directed inlet 260 to which the outlet end of the surface hose 18 is connected and an axial outlet 262 that communicates with a complementary axial inlet 264 of the member 62. The member 62, in turn, has a transversely directed outlet 266 to which the inlet end 226 of the underwater hose 16 is connected. The members 60, 62 and the tray 68 with the flotation ring 78 are rotatable about the same vertical axis. As the surface and underwater hoses 18 and 16 extend substantially horizontally adjacent the surface unit 14, the forces that the hoses 16 and 18 exert on the surface unit 14 tend to move the surface unit about on the surface. The speed and direction in which the surface unit 14 moves will depend on the relative orientation of the members 60 and 62 and the jet 70. Further, if the hoses 16 and 18 are being displaced such that the members 60 and 68 are relatively rotated too much in one direction they will reach the limit imposed by the leash 260 and further relative rotation in that direction will be halted. Due to the configuration of the underwater hose 16, and the fact that the jet connectors 32 will constantly change their relative orientations, the underwater hose 16 will, sooner or later, be displaced in such a way as to cause relative rotation of the members 60 and 62 in the opposite direction. As a result, the surface unit 14 will then move away from an obstruction. It will also be appreciated that as the surface unit 14 is linearly displaced by three forces that are randomly changing direction relative to one another, and because the periphery of the surface unit 14 is rotating, it is very unlikely that the surface unit will get stuck and its movement about the pool's surface is extremely random. As the surface unit 14 wobbles on the surface it creates large ripples that give a particularly pleasing and welcome appearance to the swimming pool. The water that is sprayed onto the surface is also pleasant and has the functional advantage of wetting items floating on the surface, thereby causing them to sink more quickly to be collected by the cleaning head 12.

The cleaning head 12 is non-buoyant in the water and has a specific gravity slightly greater than unity so that it sinks slowly in water and, in rest it lies on the floor of the pool. However, in use, due to the hydrodynamic forces exerted on it as it moves through the water it does not remain on the floor and moves through the body of water, at times moving against the floor and side walls.

I claim:

1. A displacing unit for an apparatus for cleaning a body of liquid, which includes a displacing element that is rotatable about a rotational axis;

a first hollow connecting element having an inlet connectable to a source of pressurized liquid and an outlet, the connecting element being rotatably mounted on one side of the displacing element co-axially with the rotational axis, with the inlet being transversely directed and the outlet being axially directed;

a second hollow connecting element rotatably mounted on the first connecting element co-axially with the rotational axis and having an axially directed inlet in fluid communication with the outlet of the first connecting element and a transversely directed outlet connectable to a length of hose;

a jet displacing means carried by the displacing element and in fluid communication with the interior of the first connecting element for displacing the displacing element about the rotational axis and through the liquid; and a rotation limiting means limiting relative angular rotation between the first and second connecting elements.

2. The displacing unit claimed in claim 1, which includes a buoyant means fast with the displacing element for supporting the displacing element on a surface of the body of liquid.

3. The displacing unit claimed in claim 2, in which the displacing element has a perimetral portion that is rotationally fast therewith and is engageable, in use, with a containing wall of the body of liquid.

4. The displacing unit claimed in claim 1, in combination with a first hose connected at an outlet end to the inlet of the first connecting element and a second hose connected at an inlet end to the outlet of the second connecting element, the first and second hoses each having at least one jet means intermediate its ends directed in a downstream direction to provide, in use, a thrust having a longitudinal component that is directed in an upstream direction to displace the first hose longitudinally to exert a pulling force on the first connecting element, and to displace the second hose longitudinally to exert a pushing force on the second connecting element.

5. The combination claimed in claim 4, in which the jet means are angled also to provide a thrust having a transverse component.

6. The combination claimed in claim 5, in which the jet means are movable about a longitudinal axis to vary the direction of the transverse component relative to the first and second connecting elements.

7. A support unit for an apparatus for cleaning a body of liquid, which includes a buoyant support element;

a first hollow connecting element having an inlet connectable to a source of pressurised liquid and an outlet, the connecting element being rotatably mounted on one side of the support element to be rotatable about a substantially vertical rotational axis, with the inlet being transversely directed and the outlet being axially directed;

a second hollow connecting elemnet rotatably mounted on the first connecting element co-axially with the rotational axis and having an axially directed inlet in fluid communication with the outlet of the first connecting element and a transversely directed outlet connectable to a length of hose; and a rotation limiting means for limiting relative angular rotation between the first and second connecting elements.

8. The support unit claimed in claim 7, in combination with a first hose connected at an outlet end to the inlet of the first connecting element and a second hose connected at an inlet end to the outlet of the second connecting element, the first and second hoses each having at least one jet means intermediate its ends directed in a downstream direction to provide, in use, a thrust having a longitudinal component that is directed in an upstream direction to displace the first hose longitudinally to exert a pulling force on the first connecting element and to displace the second hose longitudinally to exert a pushing force on the second connecting element.

9. The combination claimed in claim 8, in which the jet means are angled to provide a thrust also having a transverse component.

10. The combination as claimed in claim 9, in which the jet means are movable about a longitudinal axis to vary the direction of the transverse component relative to the first and second connecting elements.

11. A surface agitating unit for agitating the surface of a body of liquid, which includes a buoyant and movable support element;

a rotatable member mounted on the support element to be rotatable about a rotational axis;

a connecting means carried by the support element and connectable to a source of liquid flow;

a fluid operable displacing means carried by the rotatable member and in fluid communication with the connecting means for rotating the rotatable member; and a wobble means for imparting a wobble to the rotatable member as it rotates such that the support element disturbs the surface of the liquid.

12. The surface agitating unit claimed in claim 11, in which the wobble means includes an unbalancing mass which is fast with the rotatable member and causes it to be substantially unbalanced.

13. A support unit for an apparatus for cleaning a body of liquid, which includes a buoyant and movable support element;

a first hollow connecting element that is rotatably mounted on one side of the support element to be rotatable about a substantially vertical rotational axis and has an inlet connectable to a soruce of pressurised liquid and an outlet;

a second hollow connecting element rotatably mounted on the first connecting element co-axially with the rotational axis and having an inlet in fluid communication with the outlet of the first connecting element and an outlet connectable to a hose; and a rotation limiting means for limiting relative angular rotation between the first and second connecting elements.

14. The support unit claimed in claim 13, in which the rotation limiting means limits relative angular rotation to about 630° from one extremity to the other.

15. The support unit claimed in claim 13, in which the rotation limiting means comprises a leash that is secured at one end to the first connecting element and at the other end to the second connecting element.

16. A method of cleaning a body of liquid, which includes charging a liquid under pressure into an inlet of a first hollow connecting element in a substantially horizontal direction and below a surface defined by the liquid;

passing some of the liquid into a displacing element that is rotatably fast with the first connecting element and which floats on a surface defined by the liquid to be rotatable about a substantially vertically disposed rotational axis that passes through the first connecting element;

releasing liquid from the displacing element to cause it to rotate about the rotational axis and to displace it through the body of liquid;

passing liquid from the first connecting element downwardly into a second hollow connecting element that is rotatably fast with the first connecting element with the rotational axis passing therethrough, and horizontally therefrom into a drive hose intermediate its ends;

releasing liquid from the drive hose into the body of liquid to displace the drive hose and the displacing element through the body of liquid and also to rotate the second connecting element about the first connecting element; and limiting relative rotation of the first and second connecting elements.

17. The method claimed in claim 16 in which the first and second connecting elements are limited to rotate relative to each other through about 630°.

18. A method of agitating a surface defined by a body of liquid, which includes supporting a rotatable member at the surface;

causing the rotatable member to rotate by means of liquid flow; and causing the member to wobble as it rotates thereby to disturb the surface.

19. The method claimed in claim 18, in which the rotatable member is caused to rotate by supplying liquid under pressure to the rotatable member, and releasing liquid from the member in a suitable manner so that it rotates.

20. The method claimed in claim 18, in which the rotatable member is caused to wobble due to an unbalancing mass which substantially unbalances the rotatable member.

21. An apparatus for cleaning a swimming pool which has a conduit connected to a pump for supplying water under pressure, which includes a supply hose having an inlet end connectable to the conduit; a remote outlet end; and a displacing jet intermediate its ends that is angled towards the outlet end to exert a thrust on the supply hose where the jet is located which thrust has a transverse component and a longitudinal component directed towards the outlet end;

a surface support unit which has a buoyant support element that is rotatable about a generally vertically disposed central rotational axis; a first hollow connecting element rotatably mounted on the support element on an underneath side thereof co-axially with the rotational axis, the hollow connecting element having a transversely directed inlet connected to the outlet of the supply hose and an axially directed outlet; a second hollow connecting element rotatably mounted on the first connecting element co-axially with the rotational axis and having an axially directed inlet in fluid communication with the outlet of the first connecting element and a transversely directed outlet; a jet displacing means carried by the support element on its underneath side, in fluid communication with the interior of the first connecting element for generating a thrust on the support element that has a component that passes through the rotational axis to displace the support element and a tangential component to rotate the support element; a rotatable member mounted on a top side of the support element to be rotatable about the rotational axis and carrying a jet displacing means in fluid communication with the interior of the first connecting element for rotating the member and for spraying water onto the surface of water in the pool; an unbalancing mass carried by the member to substantially unbalance it and for causing the member to wobble as it rotates thereby causing the support element to disturb the surface of the water in the pool; and a rotation limiting means for limiting relative rotation between the first and second connecting elements;

a drive hose which has an inlet end connected to the outlet of the second connecting element; an outlet end remote from the inlet end; a plurality of drive jets located at spaced positions along the length of the drive hose each jet being angled towards the outlet end to exert a thrust on the hose where it is located which thrust has a transverse component and a longitudinal component directed towards the outlet end to exert a pushing force on the second connecting element; and at least one swivel coupling between two adjacent drive jets; and a non-buoyant debris collecting device which is connected at one end to the outlet end of the drive hose and carries a main displacing jet that is in fluid communication with the outlet end of the drive hose and is angled away from the outlet end to exert a thrust on the device which has a longitudinal component directed towards the outlet end of the drive hose and a transverse component directed towards one side; a bag that has a mouth directed towards the outlet end of the drive hose; and an auxiliary jet also in communication with the outlet end of the drive hose for providing a jet of water directed generally into the mouth of the bag.

* * * * *